US007537118B2

(12) United States Patent
Hansen

(10) Patent No.: US 7,537,118 B2
(45) Date of Patent: May 26, 2009

(54) DISPLAY PACKAGE AND METHOD OF MANUFACTURE

(75) Inventor: Jonathan C. Hansen, Rockford, MI (US)

(73) Assignee: Display Pack, Inc., Grand Rapids, MI (US)

( * ) Notice: Subject to any disclaimer, the term of this patent is extended or adjusted under 35 U.S.C. 154(b) by 383 days.

(21) Appl. No.: 11/358,803

(22) Filed: Feb. 21, 2006

(65) Prior Publication Data

US 2007/0193888 A1 Aug. 23, 2007

(51) Int. Cl.
*B65D 73/00* (2006.01)
*B65D 5/52* (2006.01)

(52) U.S. Cl. ..... 206/470; 206/45.24

(58) Field of Classification Search ..... 206/461, 206/470, 388, 463, 462, 471, 232, 806, 467, 206/45.2, 45.23, 45.24, 531, 534, 538, 332, 206/213.1, 205
See application file for complete search history.

(56) References Cited

U.S. PATENT DOCUMENTS 2,787,552 A 4/1957 Seiferth
2,873,023 A 2/1959 Erickson
3,086,869 A 4/1963 Seiferth
3,087,823 A 4/1963 Hein et al.
3,172,768 A 3/1965 Joosten et al.
3,202,277 A 8/1965 Lewi
3,247,643 A 4/1966 Bartelt
3,768,638 A 10/1973 Clarke
4,016,972 A * 4/1977 Szamborski ..... 206/6.1
4,233,801 A 11/1980 Watt
4,278,693 A 7/1981 Dingethal et al.
4,348,421 A * 9/1982 Sakakibara et al. ..... 426/394
4,387,804 A * 6/1983 Austin ..... 206/218
4,506,495 A 3/1985 Romagnoli
4,697,703 A * 10/1987 Will ..... 206/438

(Continued)

FOREIGN PATENT DOCUMENTS

GB 1063685 3/1967

OTHER PUBLICATIONS

Visual Packaging Systems Inc. Mock Clamshell Package (prior art).

(Continued)

*Primary Examiner*—Bryon P Gehman
*Assistant Examiner*—Ernesto A Grano
(74) *Attorney, Agent, or Firm*—Warner Norcross & Judd LLP

(57) ABSTRACT

A blister package having an at least partially contoured blister flange and correspondingly contoured first and second backers. The first backer includes a first flange that is coextensive with at least a portion of the blister flange. The second backer includes a second flange that is coextensive with a different portion, for example, a smaller portion or in a different location, of the blister flange than the first flange. A compartment can be defined between the first and second backers. Additional backers can be provided for additional compartments or features. The first backer can include an access panel, and the second backer can include at least one support flap that supports the blister in a stand alone position. A related method includes securing the first backer flange to the blister flange, and securing the second backer flange to the first backer flange.

10 Claims, 7 Drawing Sheets

U.S. PATENT DOCUMENTS

| | | | | | |
|---|---|---|---|---|---|
| 4,839,126 | A | | 6/1989 | Griesdorn | |
| 4,845,921 | A | | 7/1989 | Miselli | |
| 5,323,898 | A | * | 6/1994 | Kester | 206/709 |
| 5,586,657 | A | * | 12/1996 | Ward et al. | 206/705 |
| 5,735,404 | A | | 4/1998 | Kumakura et al. | |
| 5,803,248 | A | * | 9/1998 | Cox | 206/213.1 |
| 5,875,893 | A | * | 3/1999 | Lee et al. | 206/463 |
| 5,979,653 | A | * | 11/1999 | Owens et al. | 206/484.1 |
| 6,170,663 | B1 | * | 1/2001 | Glassman | 206/461 |
| 6,234,781 | B1 | | 5/2001 | Hicks et al. | |
| 6,357,593 | B1 | * | 3/2002 | Bolnick et al. | 206/531 |
| 6,488,146 | B1 | * | 12/2002 | Dotsikas | 206/217 |
| 6,726,611 | B2 | | 4/2004 | Hansen | |
| 7,293,651 | B2 | * | 11/2007 | Lee et al. | 206/463 |

OTHER PUBLICATIONS

Aqua Tab Face-Seal Blister Package (prior art).

* cited by examiner

DISPLAY PACKAGE AND METHOD OF MANUFACTURE

BACKGROUND OF THE INVENTION

The present invention relates to packaging, and more particularly to blister packages and a method for manufacturing the same.

Blister packages are devices used to package items for display at a point of sale, for example at a retail store. Blister packages are widely desirable because they are inexpensive to make and fill, and they enable packaged items to be viewed by consumers at the point of sale.

Blister packages are available in many configurations. A popular blister package, disclosed in U.S. Pat. No. 6,726,611 to Hansen, includes a transparent blister face secured to a backer, such as a paperboard panel. The blister face includes a pocket to store and display items, but also is provided with an angled blister flange. The blister face is secured to a correspondingly angled backer. Due to the angled blister/backer configuration, this blister package has increased strength, requires less material to make, and can be smaller than other conventional blister packages.

Although conventional blister packages have many benefits, it is still desirable to improve them. For example, adding information or secondary items to conventional blister packages usually requires inserting an instruction booklet or secondary item within the blister face adjacent the primary item, which can detract from the appearance of the primary item. Moreover, the inclusion of the information or secondary item can increase cost by impairing the packaging of the primary item.

SUMMARY OF THE INVENTION

The aforementioned problems are overcome in the present invention which provides a blister package including a blister face having a contoured blister face flange, a first backer having a correspondingly contoured backer flange, and a second backer also having a correspondingly contoured backer flange, where the first and second backers are joined with the blister face.

In one embodiment, the first contoured blister flange is secured to the blister face flange and the second contoured blister flange is secured to the first contoured blister flange to form a multi-layered blister package. Optionally, the second backer can be distanced from the first backer to create a compartment between the backers. Any number of additional backers can be secured to the underlying contoured backer flanges to provide additional compartments.

In another embodiment, the first backer can include an access panel. This panel can be formed by perforations, trim lines and/or die cuts in the backer. Optionally, the panel can be generally centered on an item in the blister face so that upon opening the panel, the item is easily and readily accessible.

In yet another embodiment, the first backer and/or second backer can include one or more display flaps. These flaps can be configured to fold outward from the blister package so that the blister package can stand by itself on a surface, for example, a display shelf or table.

In another aspect of the invention, the blister package is manufactured by providing at least one planar backer and a blister face having a contoured, for example, angled, flange. The backer and blister face are joined with adhesive using a special die and first heated press. The die and first heated press are shaped to correspond with the angled blister face flange. As the die and first heated press are closed, the backer is pressed into the shape of the blister face, giving the backer a peripheral margin that extends at the angle of the blister face flange. Simultaneously, the heat from the first heated press activates the adhesive coating on the backer, thereby securing the backer to the blister face along the blister flange.

A second backer can be added to the first backer and blister face in a similar manner. For example, a planar second backer can be positioned over the now-joined first backer and blister face. Another adhesive can be added to join the first and second backers. A second heated press, optionally having a shape corresponding to the die and blister face flange, but "shallower" than the first heated press, can be closed on the planar second backer so that the second backer acquires a peripheral margin that attains the contour of the blister face flange and first backer peripheral flange. Where the optional, shallower second heated press is used, a compartment can be defined between the first and second or subsequent backers.

The blister package described herein provides several benefits. First, where multiple backers are used, the blister package can provide one or more internal compartments within which to store additional information or secondary items. The space in and number of compartments can vary depending on the size of the recess formed by the blister face flange. Second, the additional internal compartment hides the additional information or secondary items. Third, the multiple backers provide additional security barriers that must be breached to reach the primary article. Fourth, the backers also add strength to the blister package. Fifth, where the first backer includes an access panel, the items stored within the blister face can easily be accessed. Sixth, where at least one of the backers includes a display flap, the flap can be folded out to transform the blister package into a stand-alone display, thereby adding yet another option to display the blister package at a point of sale.

These and other objects, advantages and features of the invention will be more readily understood and appreciated by reference to the detailed description of the invention and the drawings.

DETAILED DESCRIPTION OF THE INVENTION

I. Overview

Figure 1:
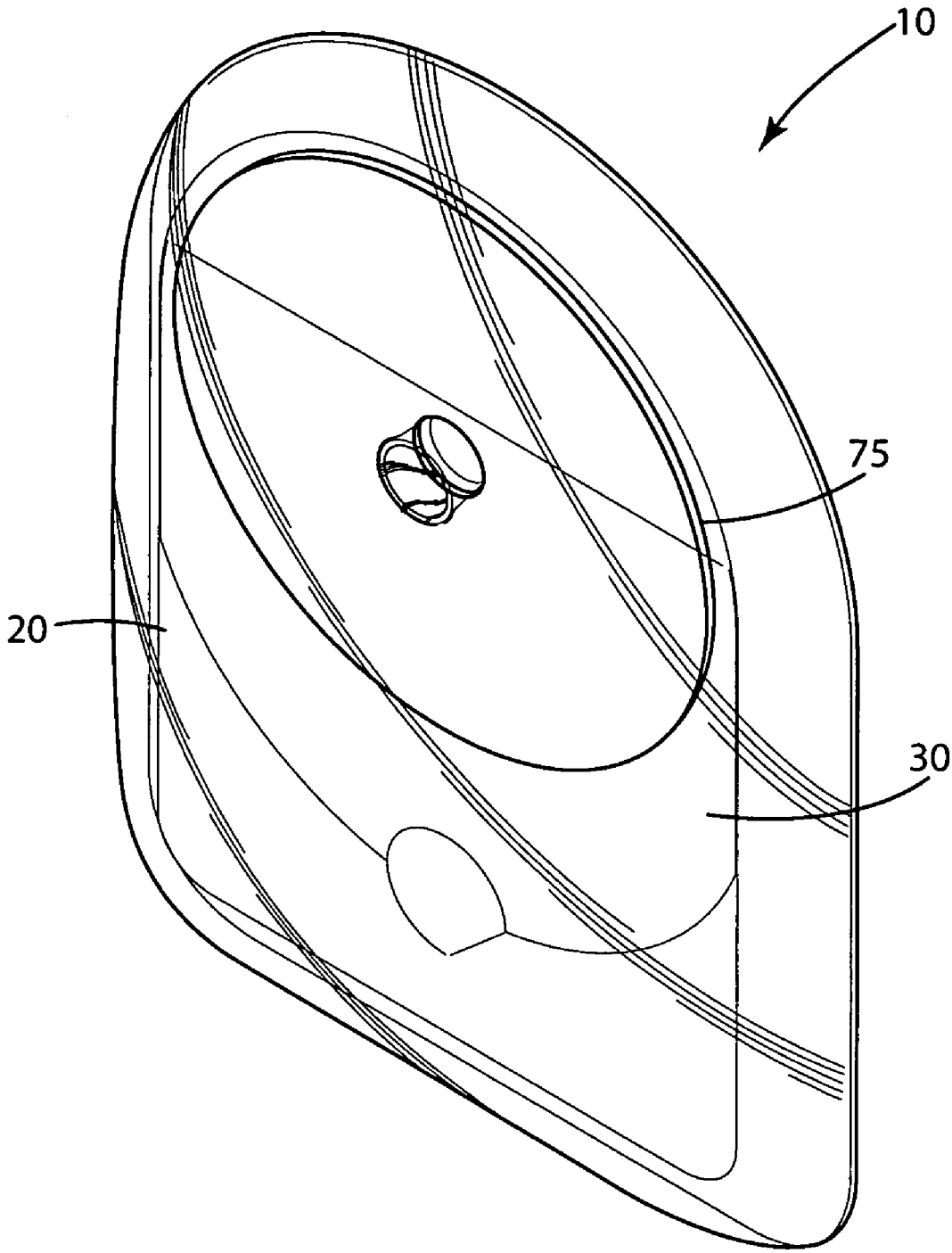
FIG. 1 is a perspective view of a blister package according to an embodiment of the present invention.
Figure 2:
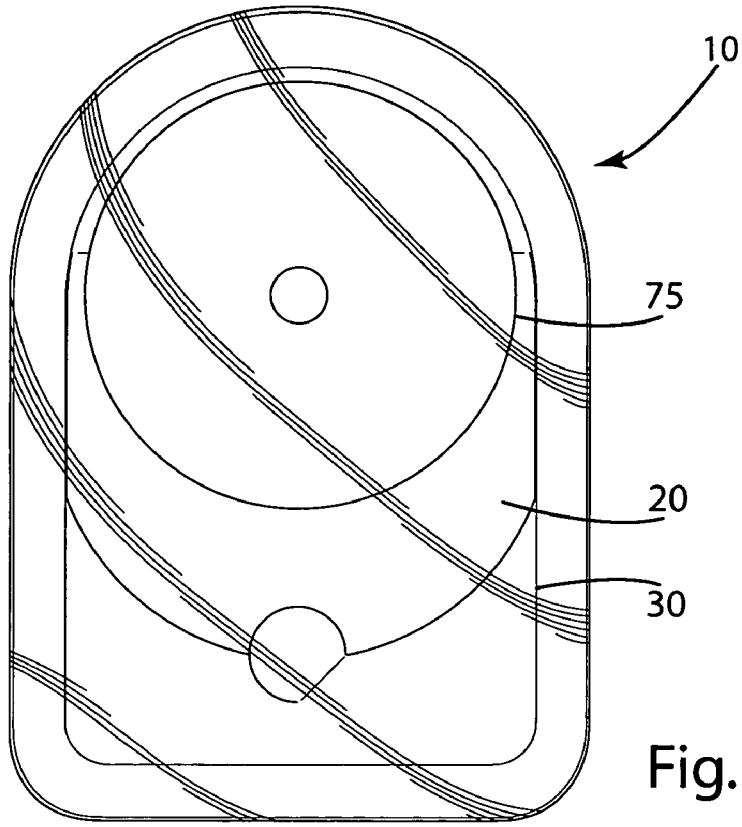
FIG. 2 is a front view of the blister package.
Figure 3:
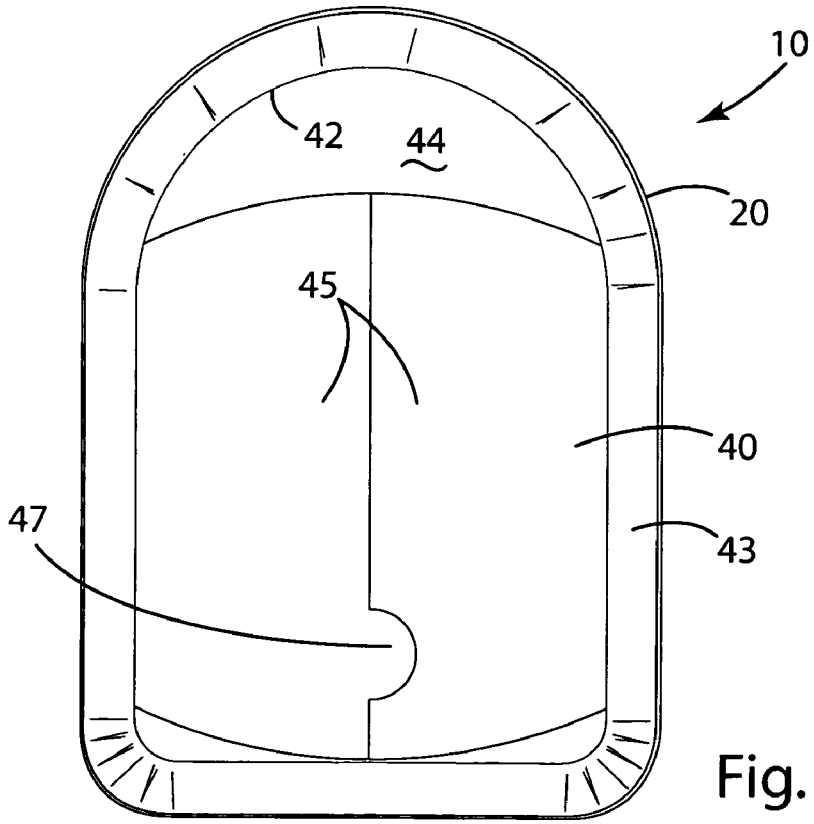
FIG. 3 is a rear view of the blister package.
Figure 4:
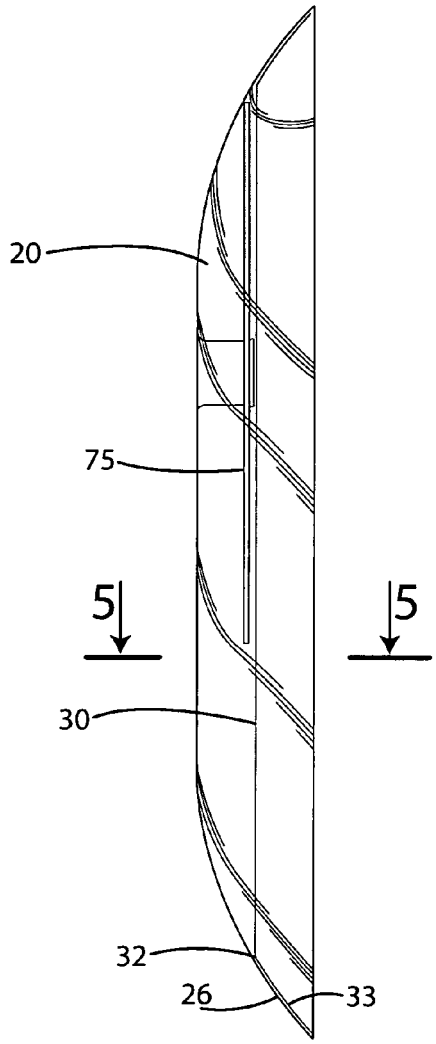
FIG. 4 is a side view of the blister package.

An embodiment of a blister package is shown in FIGS. 1-5, and generally designated 10. The blister package 10 generally includes a blister face 20, a first backer 30 and a second backer 40. The blister face 20 and first backer 30 are joined to define a space 50 for holding the desired item(s) 75. The second backer 40 is joined to at least one of the first backer 30 and the blister face 20, and can include one or more display flaps 45 that are movable away from the blister package and can support the blister package in a standing position. A compartment 55 can optionally be defined between the first and second backer for holding instructions or secondary items.

The terms "front," "back," "forward" and "rearward" as used herein denote the corresponding directions with respect to the blister package when it is hanging for display at the point of sale. For example, the front surface of the blister package is the surface of the package facing the consumer when the package is on display. The term "display plane" as used herein denotes a plane extending along the height and width of the blister when the package is on display. Typically, the display plane is a substantially vertical plane parallel to the shelf or rack that supports the package. Additionally, the term "contoured" is used herein to describe a non-planar (e.g., not in the same plane as a major portion of a main component), or three dimensional, or contoured component, whether including curved and/or differently angled portions.

II. The Blister Construction

The blister package embodiment shown in FIG. 1 will now be described in more detail. The blister face 20 can be constructed of a transparent or translucent polymer, such as polyvinyl chloride (PVC) or polyethylene terephthalate (PET). The blister face can include a main component or major surface 22 contoured to define a pocket 50 rearward from the major surface, and a flange 26 extending rearward around a periphery of surface 22. The major surface 22 can be contoured, for example contoured as shown, and/or planar, and can optionally define a hanging hole (not shown) for hanging the blister package 10 from display hooks or hanging devices at a point of sale. Further optimally, the blister face 20 can define an aperture (not shown) so that a consumer can touch or better view an article stored in the pocket or compartment 50.

The pocket 50 can extend rearward from the major surface 22 and, in the illustrated embodiment, generally can be in the shape of a semicircle atop a rectangle. The pocket 50 however, can be of any desired size or shape to define an appropriate space for containing items, and can be extend forward or rearward of the major surface 22 as desired. The pocket 50 can be configured to display the items on a display plane, which generally extends substantially vertically and substantially perpendicularly to the line of sight of consumers when the package is displayed during normal use.

Figure 5:
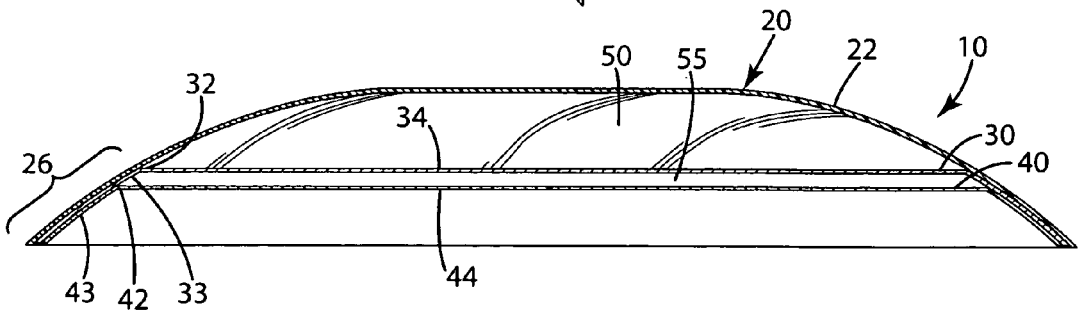
FIG. 5 is a sectional view of the blister package taken along line 5-5 of FIG. 4.
Figure 10:
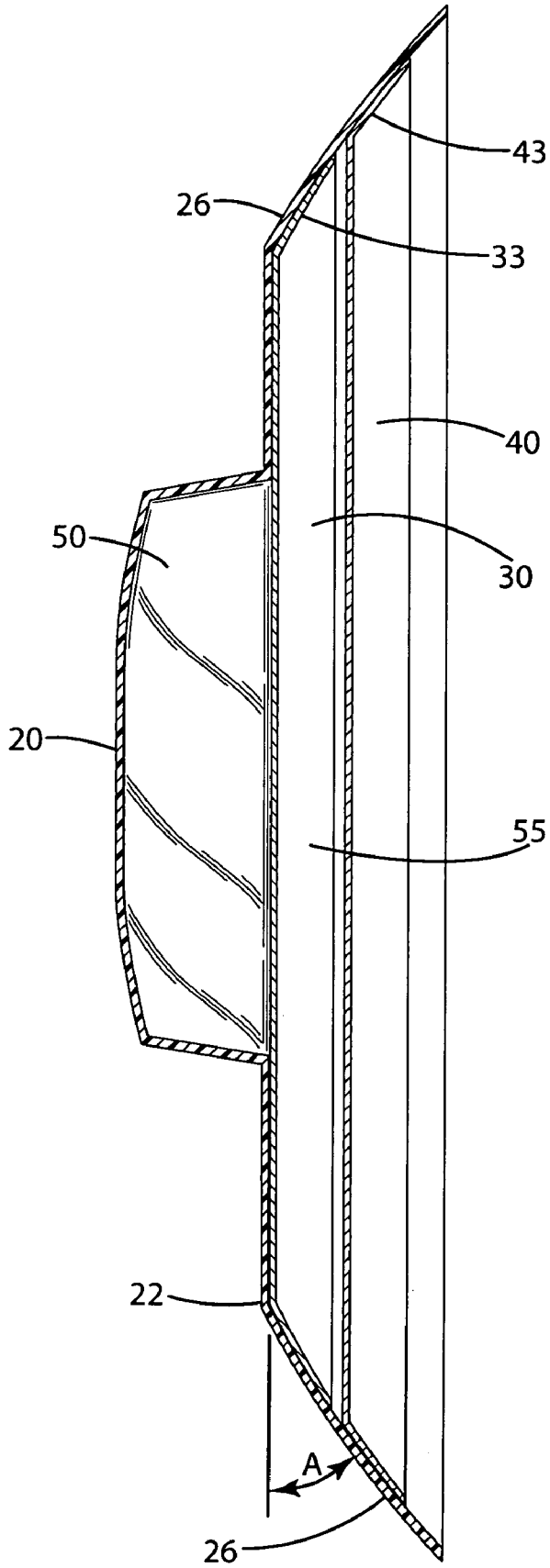
FIG. 10 is an alternative embodiment of the blister package.

The major surface 22 also can transition rearward—toward the blister face flange 26 around at least a portion of a periphery of the surface—in a manner that is subtle, e.g., where the contour of the surface 22 gradually transitions to the blister flange 26 along one or more arcs as shown in FIG. 5, and/or that is abrupt, e.g., where the flange itself is flat or slightly arced, but is at a defined angle A to the surface (see FIG. 10).

As shown in FIG. 5, the blister flange 26 can extend along a transitioning curve rearward from the periphery of the surface 22. The contour or angle of the blister flange 26 relative to the major surface 22 will vary from application, depending on the aesthetic or structural requirements.

In another embodiment, shown in FIG. 10, the blister face flange 26 can be non-planar with the major surface 22, extending at angle of approximately 40 degrees from the plane defined by the major surface 22. Again, however, the flange 26 can be shaped or contoured to provide more complex package designs. As noted above, the major surface 22 can be non-planar or may be eliminated in some applications. The contour or angle formed in the blister face 20 can significantly improve the strength and rigidity of the blister package 10 and subsequently of the blister package 10. Accordingly, the contoured blister face flange 26 permits the use of lighter weight materials than that required for similar packages with a planar flange. For many applications, the blister face 20 can be approximately 0.012, 0.015 or 0.018 of an inch in thickness (12, 15 or 18 gauge), but the thickness of the blister face 20 will vary among applications as desired.

The blister package 10 can also include one or more backers 30, 40, e.g., sheets of stock material, that are joined with the blister face 20. The backer is preferably manufactured from any of a variety of paperboard materials readily available in the industry. The backer may also be manufactured from other known backer materials, such as plastic.

As shown in FIGS. 1-6, a first backer 30 can be contoured to conform to the blister face flange 26. Specifically, the first backer 30 can include a peripheral margin 32 surrounding a first backer portion, or major portion 34. The peripheral margin 32 is contoured to form a first backer flange contour 33, which optionally corresponds with and is coextensive with at least a portion of the contour of the blister flange 26. As shown, the first backer flange contour 33 is at an angle relative to the major portion 34 of the first backer 30, and follows the contour of the blister face flange.

If desired, the first backer flange contour 33 can be coextensive and can correspond with the entire blister face flange 26. The width and height of the first backer 30 can be selected to match the dimensions that the blister face 20 would include if the blister face flange 26 was not angled (e.g., the width of the blister major portion 22 plus the actual width of the opposing flanges 26). This can enable the first backer to be substantially coextensive with the blister flange 26 when the first backer 30 is contoured to conform to the blister flange 26. The contour of the first flange contour 33 in the first backer 30 can improve the strength and rigidity of the first backer 30 and of the assembled blister package 10.

The first backer 30, and optionally the first backer flange contour 33 can be joined with the blister face 20, specifically the blister flange 26, with any suitable fastening apparatus, for example, an adhesive such as a heat activated adhesive.

Figure 6:
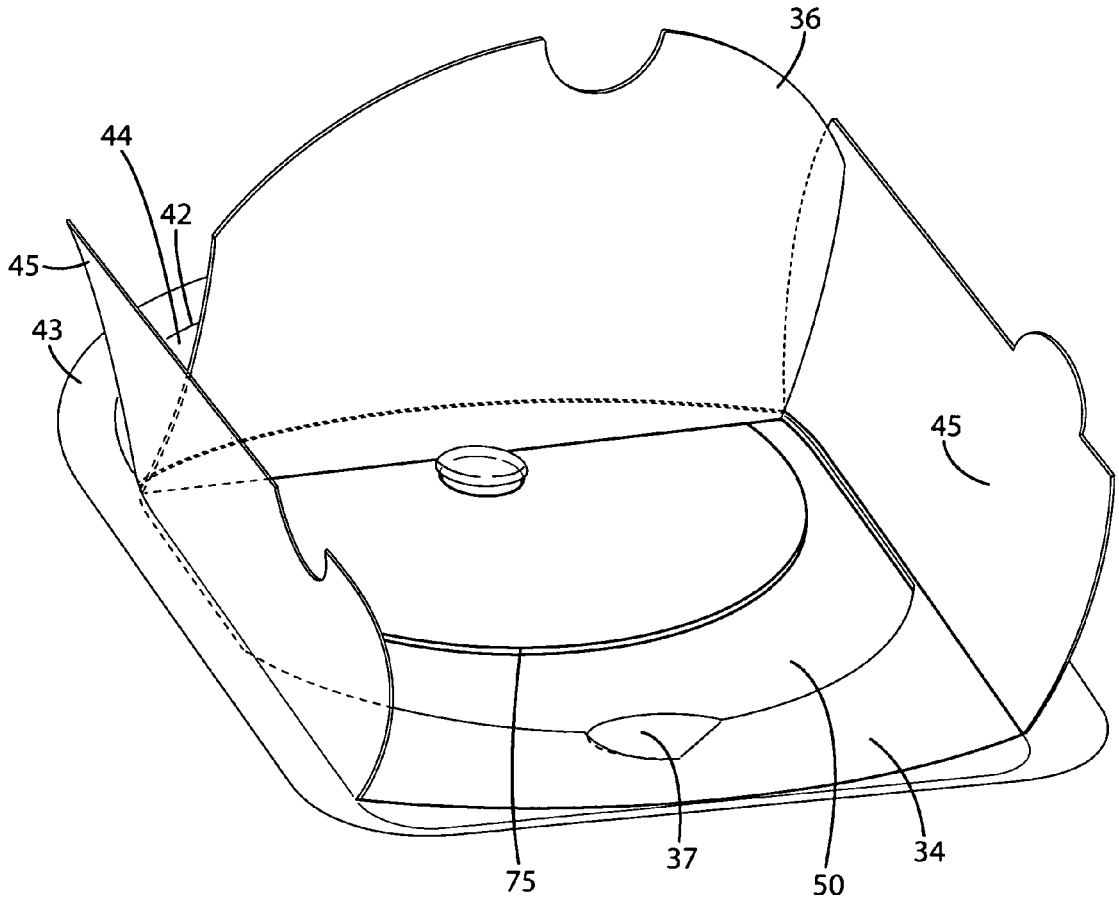
FIG. 6 is a rear view of the blister package with display flaps open and an access panel open.

With reference to FIG. 6, the first backer 30 can include one or more access panels 36, which can provide access to an item 75 within the space 50. This access panel can be formed by die cutting the first backer major portion 34 to define cut lines or perforations having the shape of the access panel in the first backer 30. Each access panel can also include one or more tabs 37 that enable a user to more easily grasp and move the access panel 36. Although shown as a partial semicircle, the access panel 36 can be of any shape desired. Further, the location of the access panel can be selected so that the panel opens with minimal or no interference with the display flaps 45 of the second backer 40.

The blister package 10 can also include a second backer 40, which is shown in FIGS. 1-6. The second backer 40 can be of the same general shape as the first backer, and can also be contoured to conform to the blister face flange 26. For example, the second backer 40 can include a peripheral margin 42 surrounding a second backer portion, or major backer portion 44. Like the first backer, the peripheral margin 42 of the second backer 40 can be contoured to form a second backer flange contour 43, which optionally corresponds with and is coextensive with at least a portion of the contour of the blister flange 26. As shown, the first backer flange contour is at an angle relative to the major portion 44 of the second backer 40, and follows the general contour of the blister face flange 26. The second backer flange contour 43 can be coextensive and can correspond with the entire blister face flange 26. The width and height of the second backer 40 can be selected using parameters similar to that used to select the first backer 30 discussed above.

Further, the second backer flange contour 43 can be coextensive with a different portion of the blister face flange 26 than the portion of the blister free flange with which the first backer flange contour 33 is coextensive. By different, it is meant that the second backer flange occupies a different location from the first backer flange, or that the second backer flange covers a different area than the first backer flange, for example, a smaller area.

With reference to FIG. 5, the second backer 40, and specifically the second backer flange contour 43, can be joined with the rearward surface of the first backer flange 33 using any suitable fastening device, for example, an adhesive such as a heat activated adhesive. Optionally, however, where the first backer flange 33 is coextensive with only a portion of the blister flange 26, e.g., extends only along a portion of the blister flange 26, the second backer flange 43 can be secured directly to the remaining, exposed portion of the blister flange 26 (FIG. 10).

The second backer 40 and first backer 30 of the blister package 10 can also cooperate to define a compartment 55 between these components. This compartment can be of any thickness or depth, and can be designed to contain any items, for example product instruction booklets or pamphlets, and/or secondary items usable with the primary item stored in the space 50 of the blister, for example, decals, tools, kit components, wires and the like. The depth of the compartment 55 can be defined by pre-selecting the distance separating the first and second backers depending on whatever is stored in the compartment.

Figure 7:
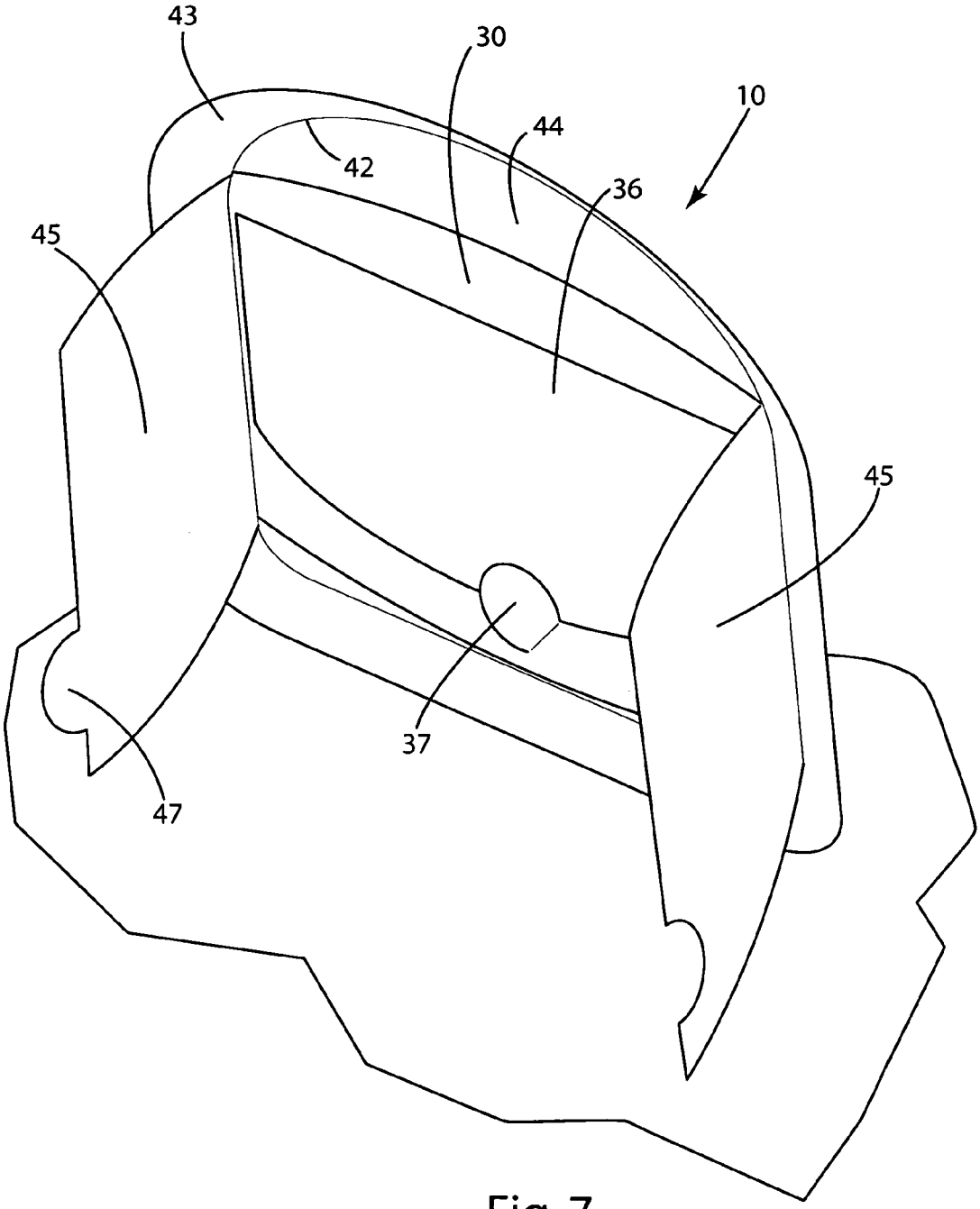
FIG. 7 is a rear perspective view of the blister package with display flaps open and the blister package in a stand alone display configuration.

Referring to FIG. 7, the second backer 40 can include one or more display flaps 45, which can be used to support the blister package 10 in a stand alone position at a point of sale, such as that shown in the figure. The display flaps 46 can be formed by die cutting the second backer major portion 44 to define cut lines or perforations having the shape of the display flaps in the second backer 40. The display flaps can also include one or more tabs 47 that enable a user to more easily grasp and move the flaps outward, away from the blister package 10, to a supporting position. Although shown as a bisected partial circle, the display flaps 45 can be of any shape desired. Further, the display flaps can be of any number, and located anywhere in relation to the second backer suitable for deployment and assistance in supporting the blister in a stand alone position. Finally, the display flaps can be located so that when opened, they exert minimal or no interference with the access panel 36 of the first backer 30.

Although the blister package 10 shown in the Figures includes only two backers and one compartment, additional backers can be added to provide additional compartments of any size as desired. Moreover, multiple access panels and display flaps can be added to any of the backers as desired and suitable for carrying out the intended functions of these components. Finally, the backers used in the blister package 10 can be approximately 0.014 of an inch in thickness (14 point), 0.021 of an inch thick (21 point) in thickness, or any other thickness as required by the application.

III. Blister Manufacture And Assembly

The blister package 10 is manufactured and assembled using a die 100 and one or more heated presses 110 that cooperate with the contoured blister face flange 26. In general, the manufacturing process includes: providing the rigid blister face 20 including the contoured blister flange 26, as described above; securing the first backer 30 to the rigid blister face 20, the first backer including a first flange contour 33 that is coextensive with at least a first portion of the contoured blister flange 26; and securing the second backer 40 to at least one of the first backer 30 and the blister face 20, the second backer 40 including a second flange contour 43 that is coextensive with at least a second portion of the contoured blister flange 26. A process suitable for use in securing the first backer and blister face is generally described in U.S. Pat. No. 6,726,611 to Hansen, which is hereby incorporated by reference. A process for joining a second backer is described below.

Figure 8:
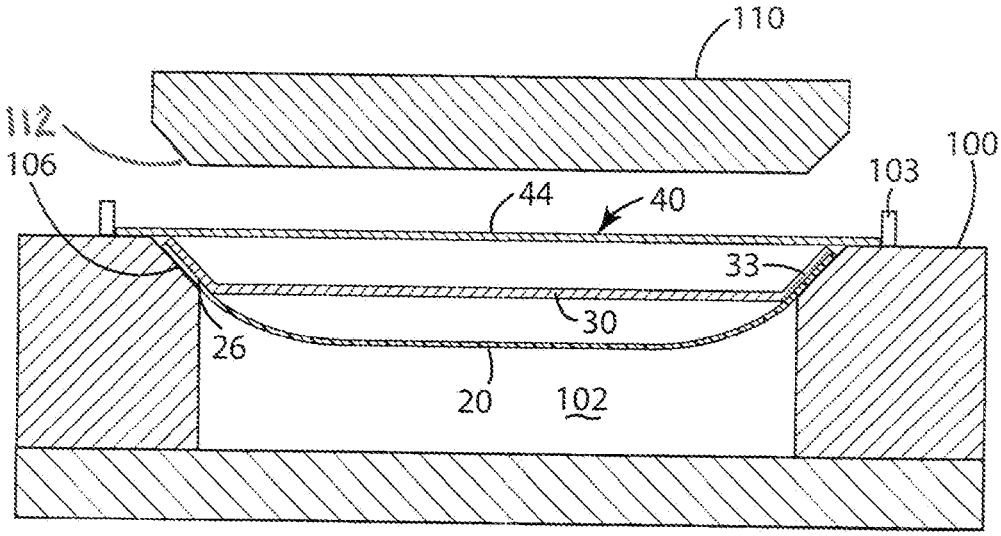
FIG. 8 is a sectional view of the blister face, first backer and a second backer in an open die and a heated press assembly.
Figure 9:
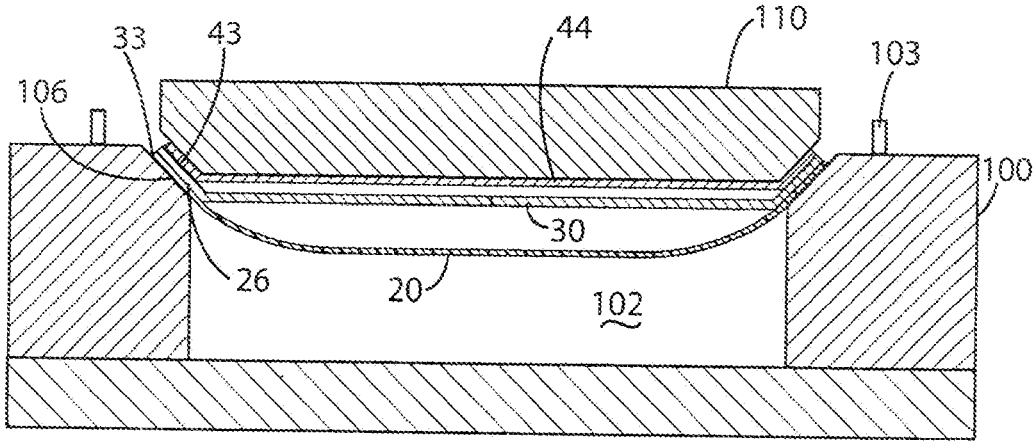
FIG. 9 is a sectional view of the blister face, first backer and the second backer in a closed die and heated press assembly.

To join a second backer, or any additional number of backers to the blister package, the machinery shown in FIGS. 8-9 can be used. As shown there, the machinery includes a die 100 and a heated press 110 (platen). The die 100 defines an opening 102 designed to receive the blister package 10, which includes already joined blister face 20 and first backer 30. The periphery 106 of the opening 102 is contoured to correspond with the contour of the blister flange 26. The heated press 110 moves with respect to the die 100. The heated press 110 includes a bottom surface 112 that is contoured and dimensioned to match at least a portion of the opening 102 of the die 100, taking into account the thickness of the blister face 20, the first backer 30 and the second backer 40. Further, it is noted that the heated press 110 is of a shallower or lesser depth than the heated press (not shown) used top join the first backer 30 to the blister face 20. This is so that the heated press does not press the second backer 40 so far into the die opening 102 so as to interfere with or damage the first backer 30. As optional, additional backers (not shown) are added to the blister package 10, the depth of succeeding heated presses may simultaneously be reduced as well.

Where a heat activated adhesive (not shown) is used to join the second backer to the blister package 10, the heated press 110 can be heated to the appropriate temperature for activating the specific adhesive applied to the backer 40 or other component to which the backer 40 is joined. The temperature, pressure and dwell time of the press can vary as desired.

The machinery operates as shown in FIGS. 8-9 to perform the manufacturing process of the blister package 10. To begin, the blister face 20 and first backer 30 optionally are made, printed, coated, filled and joined in the manner described in Hansen. Further optionally, the first backer 30 can be die cut to form one or more access panels in the backer.

After the first backer 30 and blister face 20 are joined, and the blister face loaded with the packaged item(s), the second backer 40 can be joined to one or more of these components using the machinery shown in FIGS. 8-9, or using conventional non-heat activated adhesives or features. As shown there, the blister face 20 with a first backer 30 joined thereto is inserted in the opening 102 with its flange 26 engaging the similarly contoured periphery 106 of the opening 102. With these components positioned, the planar second backer 40 is placed atop the die 100 as shown in FIG. 8. The second backer 40 can be registered with any stationary or retractable locating pins 103. Incidentally, the second backer 40 optionally can be pre-die-cut before this step to form any desired display flaps.

Next, the heated press 110 is lowered into the die opening 102 (FIG. 9) so that the press 110 reshapes the second backer 40, forcing it down into the die opening 102 against the first backer and/or blister face, and so that heat activated adhesive on the second backer joins the backer and/or blister face. Again, the heated press can be dimensioned to control the depth at which it presses the second backer major portion 44 into the opening 102, and thereby control the depth of any resulting compartment formed between the first and second backers, or additional backers when included. The heated press 110 is then raised to provide access to the finished package. For mass production, the die may include multiple die openings so that multiple packages can be formed and sealed in a single actuation of the heated press assembly.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privilege is claimed are defined as follows:

1. A blister package comprising:

a substantially rigid, blister face defining a space adapted to store articles, the blister face including a periphery and a blister face flange extending around at least a portion of the periphery, the blister face flange contoured to include a blister face flange contour, the blister face being substantially transparent to enable a viewer to view an article stored inside the space;

a first paperboard backer including a first backer portion and a first flange contour that is non-planar with the first backer portion and coextensive with at least a first portion of the blister face flange contour, the first paperboard backer including an access panel adapted to open relative to the blister face to allow access to the stored articles; and a second paperboard backer including a second backer portion and a second flange contour that is non-planar with the first backer portion and coextensive with a second portion of the blister face flange contour, the second portion of the blister face flange contour being smaller than the first portion of the blister face flange contour, the second paperboard backer including at least one substantially rigid support flap adapted for movement away from the blister face and adapted to support the blister package in an upright, stand alone position, wherein the first backer and the second backer are joined with the blister face flange wherein a compartment adapted to store articles therein is defined between the first paperboard backer and the second paperboard backer.

2. The blister package of claim 1 wherein the first backer portion and the second backer portion are substantially planar.

3. The blister package of claim 2 wherein the first backer portion and the second backer portion are separated from one another by a distance.

4. The blister package of claim 1 wherein the first backer is adhered to the blister face and the second backer is adhered to the first backer.

5. A blister package comprising:

a substantially rigid blister face defining a space adapted to store articles, the blister face including a periphery and a blister face flange extending around at least a portion of the periphery, the blister face flange contoured to include a blister face flange contour;

a first paperboard backer including a first backer portion and a first flange contour that is non-planar with the first backer portion and coextensive with at least a first portion of the blister face flange contour, the first paperboard backer including an access panel adapted to open relative to the blister face to allow access to the stored articles;

a second paperboard backer including a second backer portion and a second flange contour that is non-planar with the first backer portion and coextensive with a second portion of the blister face flange contour, the second portion of the blister face flange contour being smaller than the first portion of the blister face flange contour, the second paperboard backer including at least two support flaps adapted for movement away from the blister face and adapted to support the blister package in an upright, stand alone position, wherein the first backer and the second backer are joined with the blister face, wherein a compartment is defined between the first paperboard backer and the second paper board backer, wherein the at least two support flaps swing away from the blister face and away from one another to a position wherein the support flaps support the blister package in the upright, stand alone position.

6. The blister package of claim 5 wherein the flaps are defined by the second backer portion of the second paperboard backer.

7. A blister package comprising:

a substantially rigid blister face defining a space adapted to store articles, the blister face including a periphery and a blister face flange extending around at least a portion of the periphery, the blister face flange contoured to include a blister face flange contour, the blister face being substantially transparent to enable a viewer to view an article located in the space:

a first backer including a first backer portion and a first flange contoured to include a first flange contour that is coextensive with at least a first portion of the blister face flange contour; and a second backer including a second backer portion and a second flange contoured to include a second flange contour that is coextensive with at least a second portion of the blister face flange contour, the second portion of the blister face flange contour being different from the first portion of the blister face flange contour, wherein the first backer and the second backer are adhesively joined with the blister face flange around a substantial portion of the blister face flange, wherein the first flange contour is a portion of a curve, and wherein the portion of the curve is joined in direct engagement with the blister face flange contour.

8. A blister package comprising:

a substantially rigid blister face defining a space adapted to store articles, the blister face including a periphery and a blister face flange extending around at least a portion of the periphery, the blister face flange contoured to include a blister face flange contour, the blister face being substantially transparent to enable a viewer to view an article located in the space;

a first backer including a first backer portion and a first flange contoured to include a first flange contour that is coextensive with at least a first portion of the blister face flange contour; and a second backer including a second backer portion and a second flange contoured to include a second flange contour that is coextensive with at least a second portion of the blister face flange contour, the second portion of the blister face flange contour being different from the first portion of the blister face flange contour, wherein the first backer and the second backer are adhesively joined with the blister face flange around a substantial portion of the blister face flange, wherein the first flange contour is a portion of a curve directly adhered to the first backer portion, the first backer portion having a corresponding curve that nests with the portion of a curve of the first flange contour.

9. A blister package comprising:

a substantially rigid blister face defining a space adapted to store articles, the blister face including a periphery and a blister face flange extending around at least a portion of the periphery, the blister face flange contoured to include a blister face flange contour, the blister face being substantially transparent to enable a viewer to view an article located in the space;

a first backer including a first backer portion and a first flange contoured to include a first flange contour that is coextensive with at least a first portion of the blister face flange contour; and a second backer including a second backer portion and a second flange contoured to include a second flange contour that is coextensive with at least a second portion of the blister face flange contour, the second portion of the blister face flange contour being different from the first portion of the blister face flange contour, wherein the first backer and the second backer are adhesively joined with the blister face flange around a substantial portion of the blister face flange, wherein the second backer includes a substantially rigid display flap that supports the blister package in an upright position.

10. The blister package of claim 9 wherein the first backer includes an access panel aligned with a portion of the display flap.

* * * * *